US006138422A

United States Patent [19]

Wall et al.

[11] Patent Number: 6,138,422

[45] Date of Patent: Oct. 31, 2000

[54] POLE CAP

[75] Inventors: Wesley James Wall; Calvin Lee Michael Wall, both of Spruce Grove, Canada

[73] Assignee: Genics Inc., Spruce Grove, Canada

[21] Appl. No.: 09/406,200

[22] Filed: Sep. 27, 1999

[30] Foreign Application Priority Data

Jun. 1, 1999 [CA] Canada ..... 2273594

[51] Int. Cl.[7] ..... E04H 12/00

[52] U.S. Cl. ..... 52/300; 52/301; 52/726.4

[58] Field of Search ..... 52/300, 301, 726.4

[56] References Cited

U.S. PATENT DOCUMENTS

| | | | |
|---|---|---|---|
| D. 370,267 | 5/1996 | Bayne | D25/38 |
| 958,178 | 5/1910 | Ridgway | 52/300 |
| 3,349,532 | 10/1967 | Dudoff | 52/301 |

*Primary Examiner*—Carl D. Friedman
*Assistant Examiner*—Kevin McDermott
*Attorney, Agent, or Firm*—Christensen O'Connor; Johnson & Kindness PLLC

[57] ABSTRACT

A pole cap includes a frame having an exterior surface, an outer peripheral edge and an inner peripheral edge. The inner peripheral edge defines an opening. A removable insert is detachably secured in the opening. The insert is removable from the frame to facilitate inspection of an uppermost extremity of the pole.

15 Claims, 3 Drawing Sheets

POLE CAP

FIELD OF THE INVENTION

The present invention relates to a pole cap used for a wooden pole.

BACKGROUND OF THE INVENTION

Wooden poles are used for a wide variety of purposes; a common one being supporting wires of an electrical distribution system. Pole caps are frequently placed on top of these poles in order to shield their uppermost extremities from deterioration due to exposure to the elements. An example of such a pole cap is U.S. Pat. No. Des. 370,267. Unfortunately, some pole caps experience excessive internal condensation which actually accelerates deterioration of the pole.

SUMMARY OF THE INVENTION

What is required is an alternative configuration of pole cap.

According to the present invention there is provided a pole cap which includes a frame having an exterior surface, an outer peripheral edge and an inner peripheral edge. The inner peripheral edge defining an opening. A removable insert is detachably secured in the opening.

With the pole cap, as described above, the removable insert may be removed periodically to check the uppermost extremity of the pole. If deterioration is evidenced, wood preservative may be placed into the opening and the insert reinserted.

Although beneficial results may be obtained through the use of the pole cap, as described above, there are some additional features that assist in weather proofing the pole cap. It is preferred that the exterior surface of the frame be downwardly inclined from the inner peripheral edge to the outer peripheral edge, thereby enhancing the ability of the frame to shed water. It is preferred that the insert have an apex and a top surface which is inclined outwardly and downwardly from the apex, thereby enhancing the ability of the insert to shed water. It is preferred that the insert have a peripheral flange that overlies and shelters the inner peripheral edge of the frame.

Although beneficial results may be obtained through the use of the pole cap, as described above, there remains a concern regarding deterioration of the uppermost extremity of the pole should periodic inspections be neglected. Even more beneficial results may, therefore, be obtained when the frame is made from hygroscopic polymer plastic impregnated with wood preservative. The hygroscopic polymer plastic releases wood preservative as humidity rises, thereby reducing the likelihood of deterioration due to excessive internal condensation.

There are various means by which the insert could be detachably secured within the opening. It is preferred that the insert be friction fit within the opening. There are various ways in which this may be done, one way is to provide an insert that has a depending peripheral skirt. The opening in the frame has an interior peripheral sidewall which engages the depending peripheral skirt to detachably secure the insert in friction fit relation within the opening.

Although beneficial results may be obtained through the use of the pole cap, as described above, it would be preferable if some means could be devised to avoid the likelihood of excessive internal condensation within the pole cap. Even more beneficial results may, therefore, be obtained when one of the depending peripheral skirt of the insert and the interior peripheral sidewall of the opening has ribs which create several air flow channels between the depending peripheral skirt and the interior peripheral sidewall.

Although beneficial results may be obtained through the use of the pole cap, as described above, the locations where fasteners are used to secure the pole cap to a pole can be potential sites for deterioration. Even more beneficial results may, therefore, be obtained when the frame has a flange that extends into the opening. The flange has a plurality of openings such that the frame is secured to a pole by extending fasteners through the openings in the flange. The fastener locations, as described above, are all sheltered under the removable insert.

Although beneficial results may be obtained through the pole cap, as described above, whenever there is a removable component there is a danger of that component being dropped. If it is dropped it is a nuisance to climb down the pole to get it. There is also a danger it might be lost or damaged. Even more beneficial results may, therefore, be obtained when the insert is coupled to the frame by a tether line, such that the insert can not fall from the pole upon being removed from the opening in the frame.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
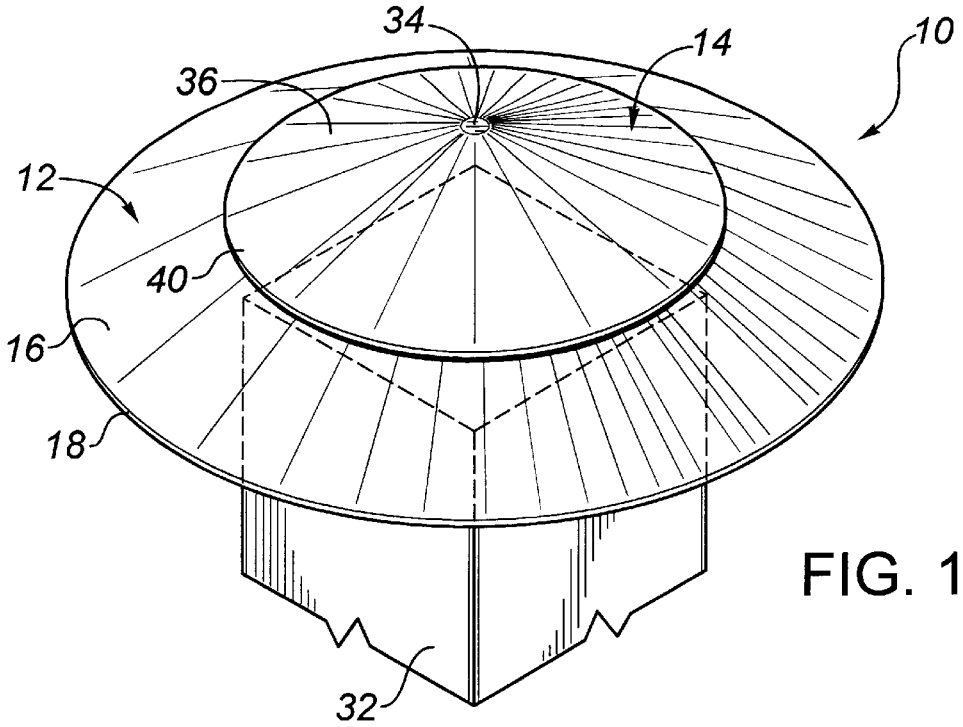
FIG. 1 is a perspective view of a pole cap constructed in accordance with the teachings of the present invention in position covering an uppermost extremity of a pole.

The preferred embodiment, a pole cap generally identified by reference numeral 10, will now be described with reference to FIGS. 1 through 5.

Figure 2:
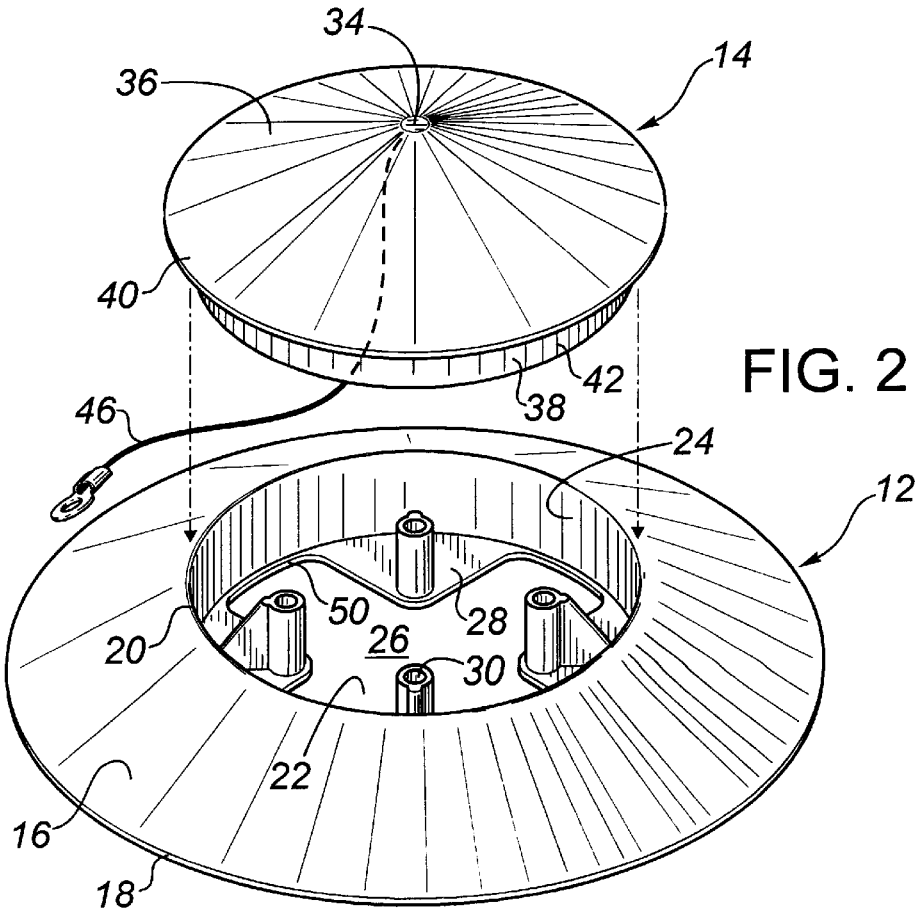
FIG. 2 is a perspective view of the pole cap illustrated in FIG. 1 with removable insert removed from the underlying frame.
Figure 3:
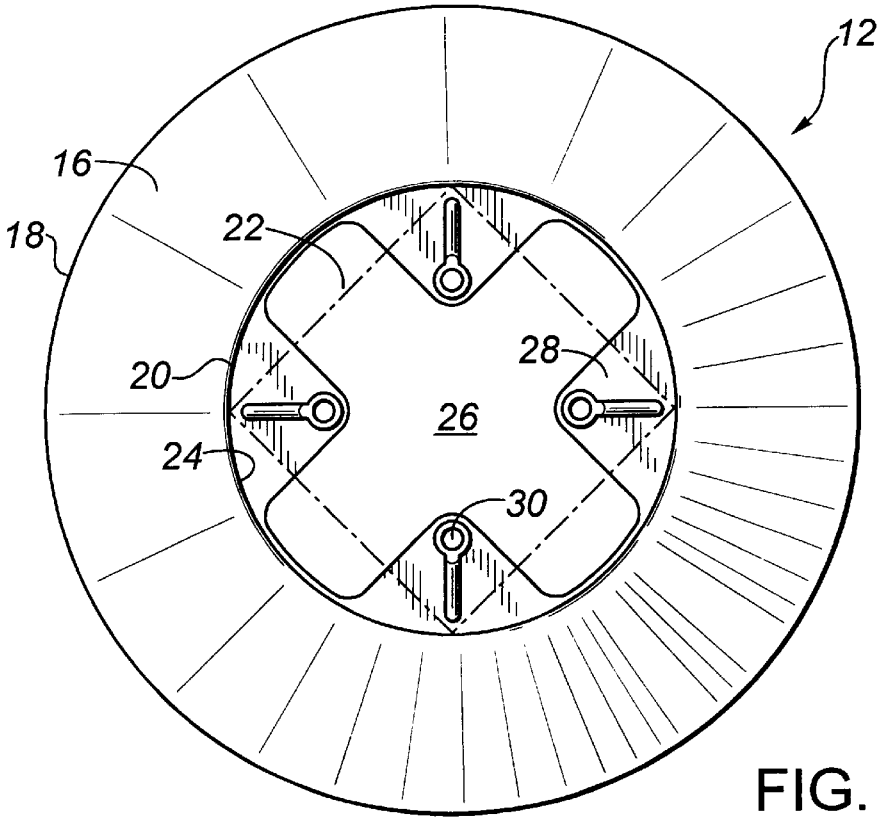
FIG. 3 is a top plan view of the frame of the pole cap illustrated in FIG. 2.
Figure 4:
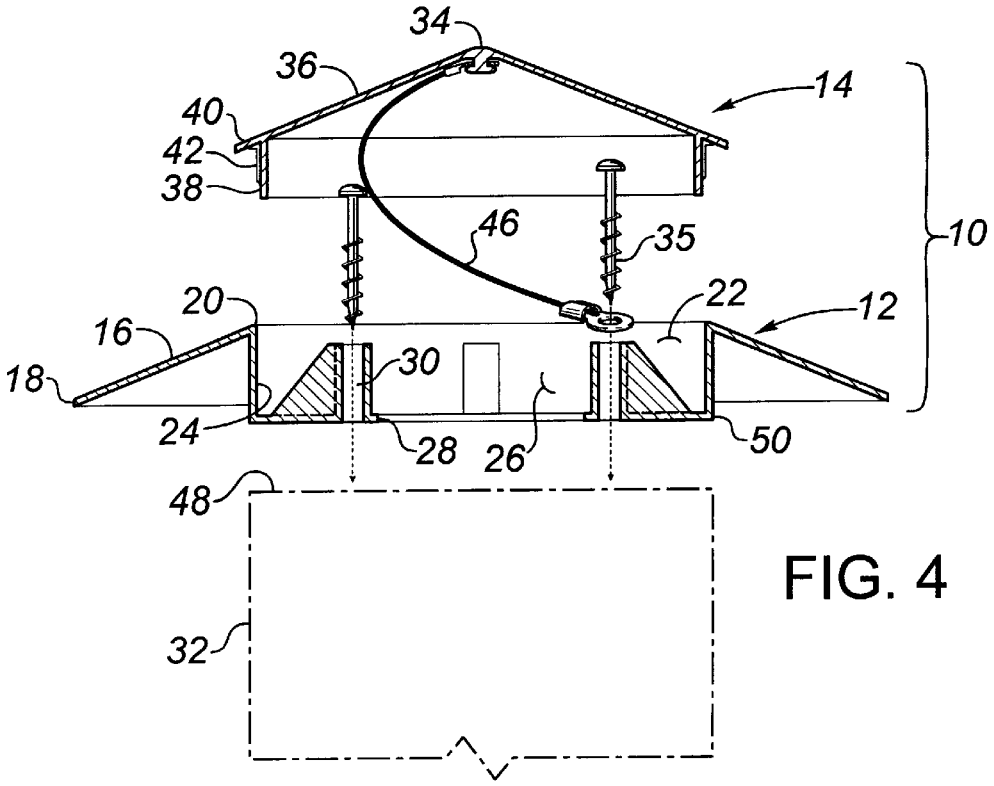
FIG. 4 is an exploded side elevation view, in section, of the pole cap illustrated in FIG. 1.
Figure 5:
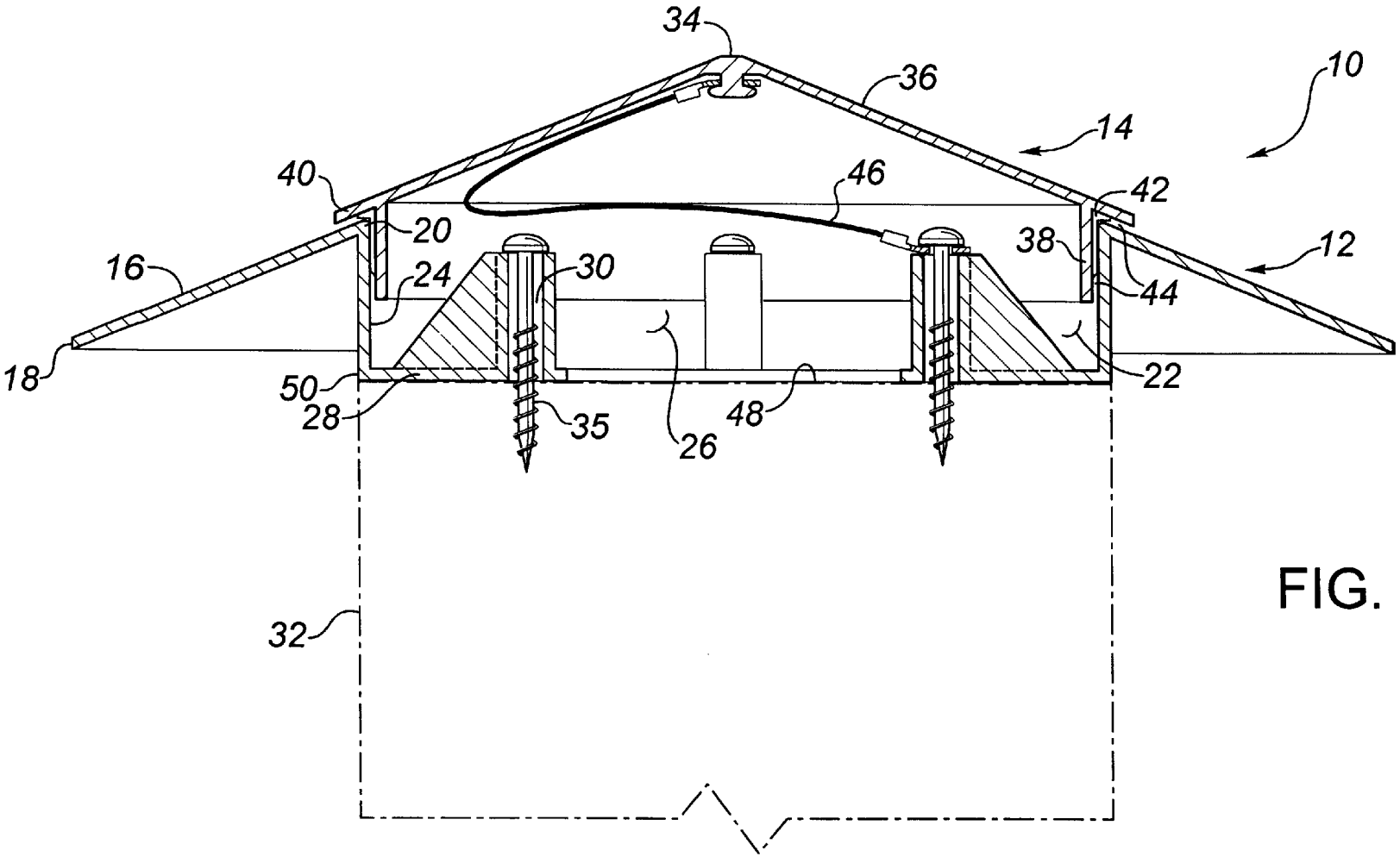
FIG. 5 is a side elevation view, in section, of the pole cap illustrated in FIG. 1.

Referring to FIG. 1, pole cap 10 includes an annular frame 12 and a removable conical insert 14. Referring to FIG. 3, frame 12 has an exterior surface 16, an outer peripheral edge 18 and an inner peripheral edge 20. Inner peripheral edge 20 of frame 12 defines an opening 22. Referring to FIG. 2, opening 22 in frame 12 has an interior peripheral sidewall 24 defining a wood preservative receiving cavity 26. Referring to FIG. 4, exterior surface 16 of frame 12 is downwardly inclined from inner peripheral edge 20 to outer peripheral edge 18. Frame 12 has a flange 28 that extends into opening 22 at a bottom edge 50 of sidewall 24. Flange 28 has a plurality of apertures 30. Referring to FIG. 5, frame 12 is secured to a top 48 of a pole 32 by extending fasteners 35 through apertures 30 in flange 28.

Frame 12 is made from hygroscopic polymer plastic impregnated with wood preservative. When installed, the polymer plastic containing wood preservative of frame 12 is in intimate contact with top 48 of pole 32. The hygroscopic polymer plastic releases wood preservative as humidity rises. Top 48 of pole 32 can be inspected through opening 22, there is no need to remove frame 12 from top of pole 32 to conduct an inspection.

Referring to FIG. 4, removable conical insert 14 has an apex 34 and a top surface 36 which is inclined outwardly and downwardly from apex 34, a depending peripheral skirt 38 and a peripheral flange 40. Referring to FIG. 5, removable insert 14 is friction fitted within opening 22 of frame 12 with peripheral flange 40 overlying and sheltering inner peripheral edge 20 of frame 12. When precipitation falls on pole cap 10, water flows down inclined surface 36 of insert 14 and inclined surface 16 of frame 12, without entering cavity 26. Referring to FIG. 4, depending peripheral skirt 38 has axially extending ribs 42. Referring to FIG. 5, ribs 42, frictionally engage interior peripheral sidewall 24 of frame 12 when insert 14 is inserted into opening 22 of frame 12. Several air flow channels 44 between ribs 42 are created between depending peripheral skirt 38 of insert 14 and interior peripheral sidewall 24 of frame 12. Circulation of air through channels 44 prevents an excessive amount of condensation building up within cavity 26. Insert 14 is coupled to frame 12 by a tether line 46, such that insert 14 can not fall from pole 32 upon being removed from opening 22 in frame 12.

Referring to FIG. 5, when insert 14 is in place within opening 22 of frame 12, fasteners 35 are enclosed within cavity 26. The effects of weather on fasteners 35 so enclosed are greatly reduced when compared to fasteners for alternative designs of pole cap in which said fasteners are exposed to the weather.

From time to time it is desirable to inspect a top 48 of pole 32 for signs of deterioration. To view top 48 of pole 32, insert 14 is removed from opening 22 in frame 12. If an onset of deterioration is detected, wood preservative can be added into cavity 26 before replacing insert 14 within opening 22.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A pole cap, comprising:

a frame having an exterior surface, an outer peripheral edge and an inner peripheral edge, the inner peripheral edge defining an opening; and a removable insert detachably secured in the opening, the exterior surface of the frame being downwardly inclined from the inner peripheral edge to the outer peripheral edge, thereby enhancing the ability of the frame to shed water.

2. The pole cap as defined in claim 1, wherein the frame is annular.

3. The pole cap is defined in claim 1, wherein the insert has an apex and a top surface which is inclined outwardly and downwardly from the apex, thereby enhancing the ability of the insert to shed water.

4. The pole cap as defined in claim 1, wherein the insert has a peripheral flange that overlies and shelters the inner peripheral edge of the frame.

5. A pole cap, comprising:

a frame having an exterior surface, an outer peripheral edge and an inner peripheral edge, the inner peripheral edge defining an opening; and a removable insert detachably secured in the opening, the frame being made from hygroscopic polymer plastic impregnated with wood preservative, such that the hygroscopic polymer plastic releases wood preservative as humidity rises.

6. A pole cap, comprising:

a frame having an exterior surface, an outer peripheral edge and an inner peripheral edge, the inner peripheral edge defining an opening; and a removable insert detachably secured in the opening;

wherein the insert has a depending peripheral skirt and the opening in the frame has an interior peripheral sidewall which engages the depending peripheral skirt to detachably secure the insert in friction fit relation within the opening and of the depending peripheral skirt of the insert and the interior peripheral sidewall of the opening has ribs which create several air flow channels between the depending peripheral skirt and the interior peripheral sidewall.

7. A pole cap, comprising:

a frame having an exterior surface, an outer peripheral edge and an inner peripheral edge, the inner peripheral edge defining an opening; and a removable insert detachably secured in the opening, the frame having a flange that extends into the opening, the flange having a plurality of openings such that the frame is secured to a pole by extending fasteners through the openings in the flange.

8. A pole cap, comprising:

a frame having an exterior surface, an outer peripheral edge and an inner peripheral edge, the inner peripheral edge defining an opening; and a removable insert detachably secured in the opening, the insert being coupled to the frame by a tether line, such that the insert can not fall from the pole upon being removed from the opening in the frame.

9. The pole cap as defined in claim 8, wherein the insert is friction fit within the opening.

10. A pole cap, comprising:

a frame having an exterior surface, an outer peripheral edge and an inner peripheral edge, the inner peripheral edge defining an opening, the opening in the frame having an interior peripheral sidewall, the exterior surface of the frame being downwardly inclined from the inner peripheral edge to the outer peripheral edge, the frame having a flange that extends into the opening, the flange having a plurality of apertures such that the frame is secured to a pole by extending fasteners through the apertures in the flange; and a removable insert having an apex and a top surface which is inclined outwardly and downwardly from the apex, a depending peripheral skirt and a peripheral flange, the removable insert being friction fit within the opening with the peripheral flange overlying and sheltering the inner peripheral edge of the frame.

11. The pole cap as defined in claim 10, wherein the frame is annular.

12. The pole cap as defined in claim 10, wherein the frame is made from hygroscopic polymer plastic impregnated with wood preservative, such that the hygroscopic polymer plastic releases wood preservative as humidity rises.

13. The pole cap as defined in claim 10, wherein one of the depending peripheral skirt of the insert and the interior peripheral sidewall of the opening has ribs which create several air flow channels between the depending peripheral skirt and the interior peripheral sidewall.

14. The pole cap as defined in claim 10, wherein the insert is coupled to the frame by a tether line, such that the insert can not fall from the pole upon being removed from the opening in the frame.

15. A pole cap, comprising:

an annular frame having an exterior surface, an outer peripheral edge and an inner peripheral edge, the inner peripheral edge defining an opening, the opening in the frame having an interior peripheral sidewall defining a wood preservative receiving cavity, the exterior surface of the frame being downwardly inclined from the inner peripheral edge to the outer peripheral edge, the frame having a flange that extends into the opening, the flange having a plurality of apertures such that the frame is secured to a pole by extending fasteners through the apertures in the flange, the frame being made from hygroscopic polymer plastic impregnated with wood preservative, such that the hygroscopic polymer plastic releases wood preservative as humidity rises;

a removable conical insert having an apex and a top surface which is inclined outwardly and downwardly from the apex, a depending peripheral skirt and a peripheral flange, the removable insert being friction fit within the opening with the peripheral flange overlying and sheltering the inner peripheral edge of the frame, the depending peripheral skirt having axially extending ribs which create several air flow channels between the depending peripheral skirt and the interior peripheral sidewall; and the insert being coupled to the frame by a tether line, such that the insert can not fall from the pole upon being removed from the opening in the frame.

* * * * *